US007154446B2

(12) United States Patent
Hirota et al.

(10) Patent No.: US 7,154,446 B2
(45) Date of Patent: Dec. 26, 2006

(54) FEED HORN STRUCTURE AND MANUFACTURING METHOD THEREOF, CONVERTER, AND SATELLITE COMMUNICATION RECEIVING ANTENNA

(75) Inventors: Makoto Hirota, Kobe (JP); Hiroyuki Suga, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 144 days.

(21) Appl. No.: 10/327,867

(22) Filed: Dec. 26, 2002

(65) Prior Publication Data

US 2003/0117332 A1 Jun. 26, 2003

(30) Foreign Application Priority Data

Dec. 26, 2001 (JP) ..... 2001-394508

(51) Int. Cl.
*H01Q 13/00* (2006.01)

(52) U.S. Cl. ..... 343/786; 343/872

(58) Field of Classification Search ..... 343/786, 343/872, 772, 784; 29/600
See application file for complete search history.

(56) References Cited

U.S. PATENT DOCUMENTS

| | | | | |
|---|---|---|---|---|
| 4,811,031 | A * | 3/1989 | Maile et al. | 343/840 |
| 5,117,240 | A * | 5/1992 | Anderson et al. | 343/786 |
| 5,699,072 | A | 12/1997 | Tokuda et al. | |
| 6,353,418 | B1 * | 3/2002 | Burger et al. | 343/786 |
| 6,501,432 | B1 * | 12/2002 | Yuanzhu | 343/772 |
| 6,666,631 | B1 * | 12/2003 | Yajima et al. | 409/137 |

FOREIGN PATENT DOCUMENTS

| | | | |
|---|---|---|---|
| DE | 3144319 | A1 | 11/1981 |
| DE | 3410503 | C2 | 3/1984 |
| DE | 37 80 287 | T2 | 12/1987 |
| DE | 42 13 539 | A1 | 4/1992 |
| DE | 299 05 435 | U1 | 3/1999 |
| EP | 0 322 498 | A2 | 7/1989 |
| GB | 835000 | | 5/1960 |
| GB | 2 221 351 | A | 1/1990 |
| GB | 2 301 484 | A | 12/1996 |
| JP | 53142687 | A | 12/1978 |
| JP | 56104264 | A | 8/1981 |
| JP | 60134602 | A | 7/1985 |
| JP | 62-47207 | U | 3/1987 |
| JP | 63-12904 | U | 1/1988 |
| JP | 5-110330 | | 4/1993 |
| JP | 5-74033 | U | 10/1993 |
| JP | 6-81120 | | 11/1994 |
| JP | 6-81120 | U | 11/1994 |
| JP | 7-22804 | A | 1/1995 |
| JP | 7-38321 | | 2/1995 |
| JP | 7-38321 | A | 2/1995 |
| JP | 7321542 | A | 12/1995 |
| JP | 8-307120 | A | 11/1996 |

(Continued)

*Primary Examiner*—Hoanganh Le
(74) *Attorney, Agent, or Firm*—Birch, Stewart, Kolasch & Birch, LLP.

(57) ABSTRACT

A feed horn structure in which a feed horn and a horn cap can be combined and, a manufacturing method thereof. A converter having that feed horn structure, and a satellite communication receiving antenna can be obtained. The feed horn structure of a satellite communication receiving converter includes a cylindrical feed horn receiving a radio wave from an antenna portion and guiding the radio wave, and a horn cap fixed to the feed horn so as to surround one end of the feed horn at antenna side. The feed horn and the horn cap are integrated by integral molding.

7 Claims, 8 Drawing Sheets

FOREIGN PATENT DOCUMENTS

| | | | |
|---|---|---|---|
| JP | 9-46102 | | 2/1997 |
| JP | 9-46102 | A | 2/1997 |
| JP | 9-119598 | A | 5/1997 |
| JP | 9-147626 | A | 6/1997 |
| JP | 10-211647 | A | 8/1998 |
| JP | 2001-119202 | A | 4/2001 |
| JP | 2001-278293 | A | 10/2001 |
| JP | 2001-284956 | A | 10/2001 |
| WO | WO 94/01899 | | 1/1994 |

* cited by examiner

FEED HORN STRUCTURE AND MANUFACTURING METHOD THEREOF, CONVERTER, AND SATELLITE COMMUNICATION RECEIVING ANTENNA

BACKGROUND OF THE INVENTION

1. Field of the Invention

The present invention relates to a feed horn structure for receiving satellite communications, specifically, satellite broadcastings, and manufacturing method thereof, a converter with the feed horn structure, and a satellite communications receiving antenna.

2. Description of the Related Art

FIG. 11 is a perspective view of a satellite broadcasting receiving antenna. Radio waves from a satellite are reflected at a parabola antenna 150 and enter a feed horn 101 and guided. The radio waves thus guided are converted by a converter 140 connected to feed horn 101 into television signals or audio signals (e.g., Japanese Patent Laying-Open No. 7-38321, Japanese, Patent Laying-Open No. 9-46102, Japanese Utility Model Laying-Open No. 6-81120).

FIG. 12 is a front view of a feed horn structure with a horn cap, showing their vertical cross section, in a conventional LNB (Low Noise Block down) converter. FIG. 13 is a cross sectional view of the feed horn structure above along the line XIII—XIII in FIG. 12. As shown in FIGS. 12 and 13, conventionally, feed horn 101 and horn cap 102 are removable from each other, and forming the feed horn structure when combined together. Of these feed horn structure elements, the horn cap must be formed with a material "transparent" to radio waves that does not attenuate incidental radio waves, i.e., must be formed with a non-conductive material, as a minimum requirement. As for the feed horn, since it serves as a waveguide tube, at least the inner surface thereof must be formed with a conductor. To this end, both of the parts are conventionally manufactured separately as separate members and combined together at an assembly step. In the assembly step, a plurality of hooks 103 provided on the horn cap are mated with feed horn 101, and thus they are combined.

According to the combining method above, the balance of the mating force may be disturbed, resulting in generation of whitening or crack near the hooks of the horn cap. Additionally, since an O ring 104 is used to maintain the airtightness, the cost is increased.

Therefore, there has been a need for a feed horn structure that combines the feed horn and the horn cap without employing the structure such as the above mentioned hooks yielding large stress concentration.

SUMMARY OF THE INVENTION

The present invention provides a feed horn structure in which a feed horn and a horn cap are combined without generating whitening, crack and the like, a manufacturing method thereof, a converter having that feed horn structure, and a satellite communication receiving antenna.

A feed horn structure of a satellite communication receiving converter according to the present invention includes a cylindrical feed horn receiving a radio wave from an antenna portion and guiding the radio wave, and a horn cap fixed to the feed horn so as to surround one end of the feed horn at antenna side. The feed horn and the horn cap are integrated by integral molding.

With this configuration, since the feed horn and the horn cap are integrated by integral molding, hooks for fixing the horn cap are no longer required, and generation of troubles such as whitening or cracks is prevented. Additionally, since airtightness is attained by integral molding, an O ring can be eliminated and thus costs are reduced.

According to the feed horn structure of the present invention, the feed horn may be integrally molded with the horn cap of a resin material by blow molding.

With this configuration, the feed horn and the horn cap can be easily integrated to maintain airtightness.

According to the feed horn structure of the present invention, the feed horn and the horn cap may be stopped by a concave portion and a convex portion thereof mating with each other, in order to prevent displacement of the horn cap relative to the feed horn.

With this configuration, the feed horn and the horn cap are prevented from displacement, specifically, rotational displacement by the simple structure, and can be integrated.

According to the feed horn structure of the present invention, the feed horn may be a die-cast feed horn.

With this configuration, the feed horn may be formed with aluminum or the like at low costs. Further, since it can be drawn well, it may easily be integrally molded.

According to the feed horn structure of the present invention, the feed horn may be configured with a weather-resistant resin provided to inner surface with a plating.

With this configuration, a lightweight and weather-resistant feed horn structure may be attained. The plating must be provided at least on its inner surface, and optionally it may be provided on its entire surface.

According to the feed horn structure of the present invention, the feed horn may be configured with a general purpose resin provided with a plating.

With this configuration, a cost-effective and lightweight feed horn structure may be attained. Similarly, the plating must be provided at least on its inner surface, and optionally it may be provided on its entire surface.

According to the feed horn structure of the present invention, the feed horn may be formed by sheet metal working.

With this configuration, an aluminum plate or a steel plate may be performed with sheet metal working for cost-effective and efficient manufacture.

A satellite transmission receiving converter according to the present invention includes a cylindrical feed horn receiving a radio wave from an antenna portion and guiding the radio wave, and a horn cap fixed to the feed horn so as to surround one end of the feed horn at antenna side. The feed horn and the horn cap are integrated by integral molding.

With this configuration, a cost-effective converter without defects may be attained effectively.

A satellite communication receiving antenna of the present invention includes an antenna portion and a converter. The converter includes a cylindrical feed horn receiving a radio wave from an antenna portion and guiding the radio wave, and a horn cap fixed to the feed horn so as to surround one end of the feed horn at antenna side. The feed horn and the horn cap are integrated by integral molding.

With this configuration, a cost-effective satellite communication receiving antenna without defects may be attained effectively.

A method of manufacturing a feed horn structure of a satellite communication receiving converter according to the present invention includes a step of mounting a cylindrical feed horn to a blow molder, a step of mounting a parison to be a horn cap to the heed horn so as to surround one end of the feed horn and pressing the parison with a blowing mold, and a step of blowing compressed air from the other end of the feed horn toward the parison, to mold the parison in a shape conforming to the blowing mold.

With this configuration, the feed horn structure in which the feed horn and the horn cap are tightly fixed to each other can be formed effectively and at low costs, without generating stress concentration.

The foregoing and other objects, features, aspects and advantages of the present invention will become more apparent from the following detailed description of the present invention when taken in conjunction with the accompanying drawings.

DESCRIPTION OF THE PRESENT INVENTION

In the following, embodiments of the present invention will be described referring to the figures.

(First Embodiment)

Figure 1:
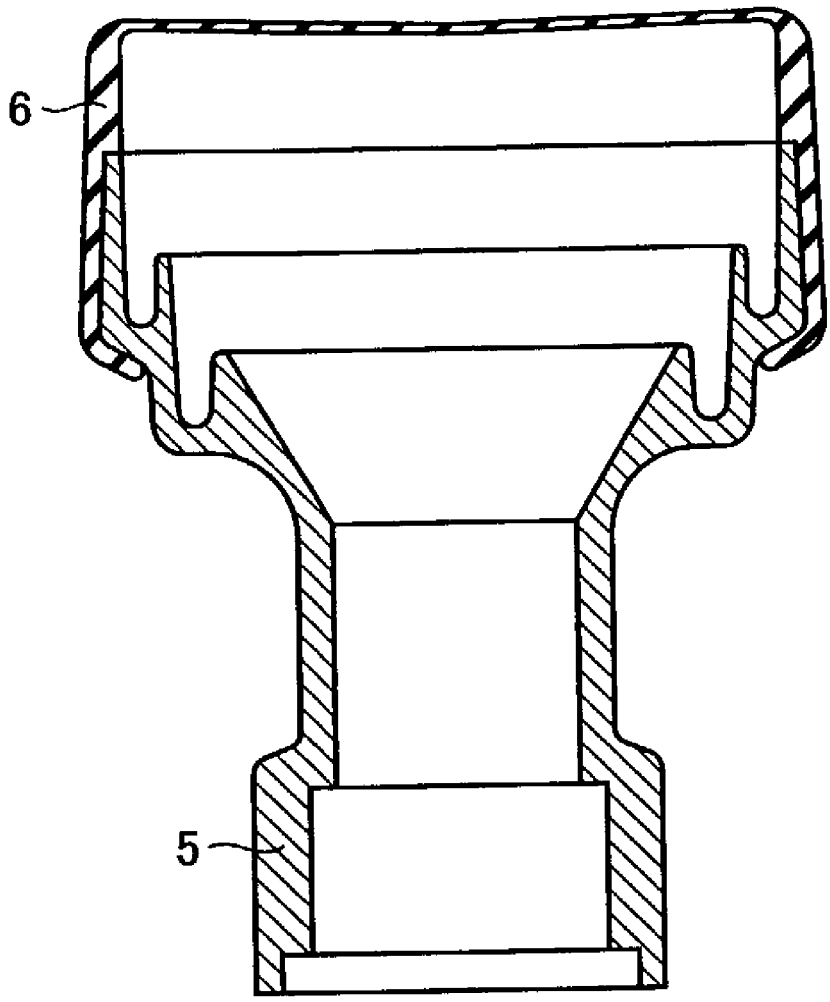
FIG. 1 is a front view showing vertical cross section of a feed horn structure according to a first embodiment of the present invention.

FIG. 1 is a front view showing vertical cross section of a feed horn structure according to a first embodiment of the present invention. A horn cap 6 and a die-cast feed horn 5 are integrated by integral molding. Thus, there is no need to mount the horn cap to the feed horn employing hooks or the like in the manufacturing step, and hence whitening, cracks and the like will not be generated. Therefore, the manufacturing yield is improved and the manufacturing cost can be reduced. Further, an expensive O ring for maintaining airtightness can be eliminated, and thus the cost reduction can be attained.

Figure 2:
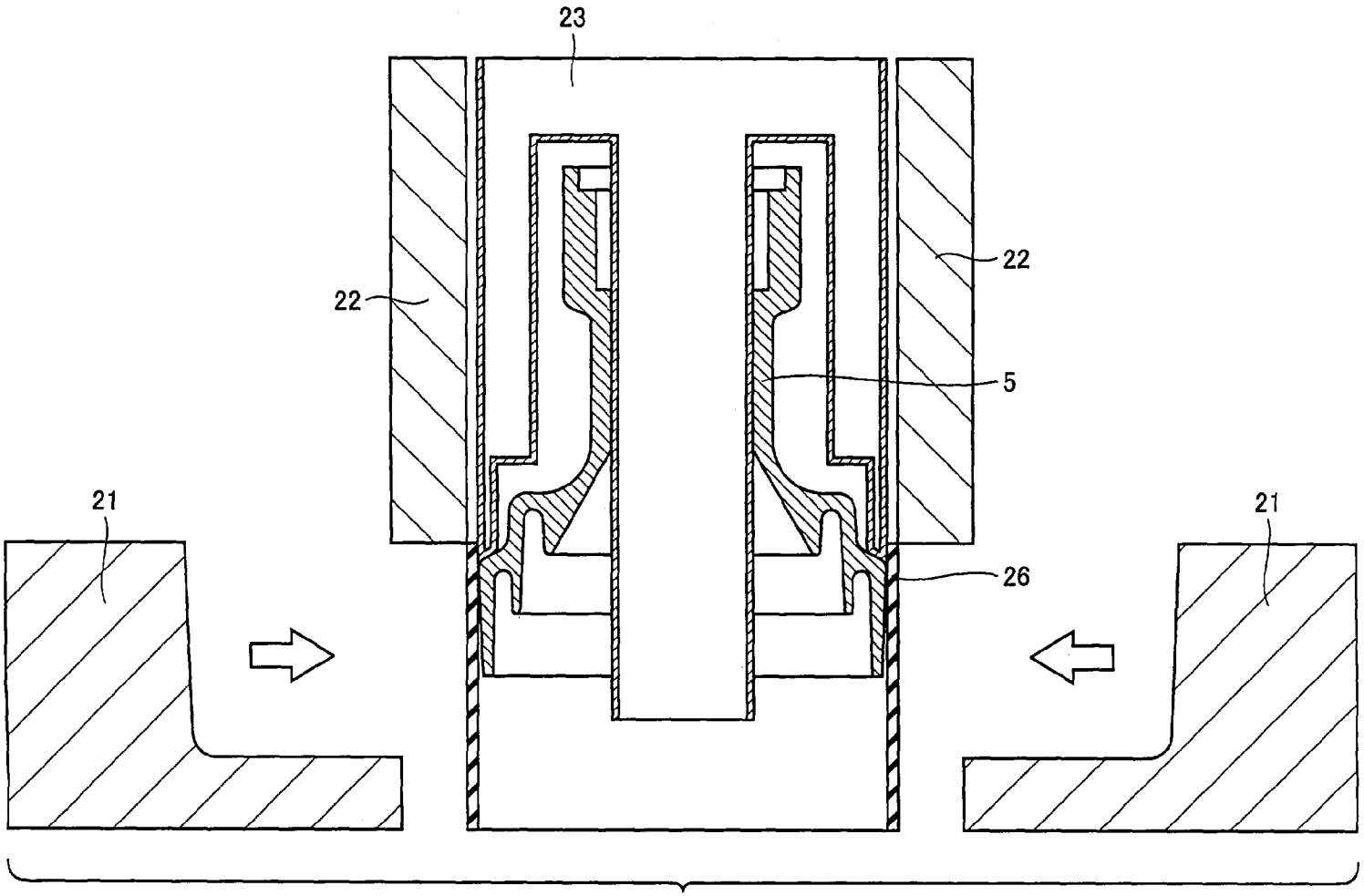
FIG. 2 is a cross sectional view showing a feed horn in one step of manufacturing method of the feed horn structure in FIG. 1, in which the feed horn is mounted to a blow molder with a parison 26 of a molded resin material mounted to one end of the feed horn.
Figure 3:
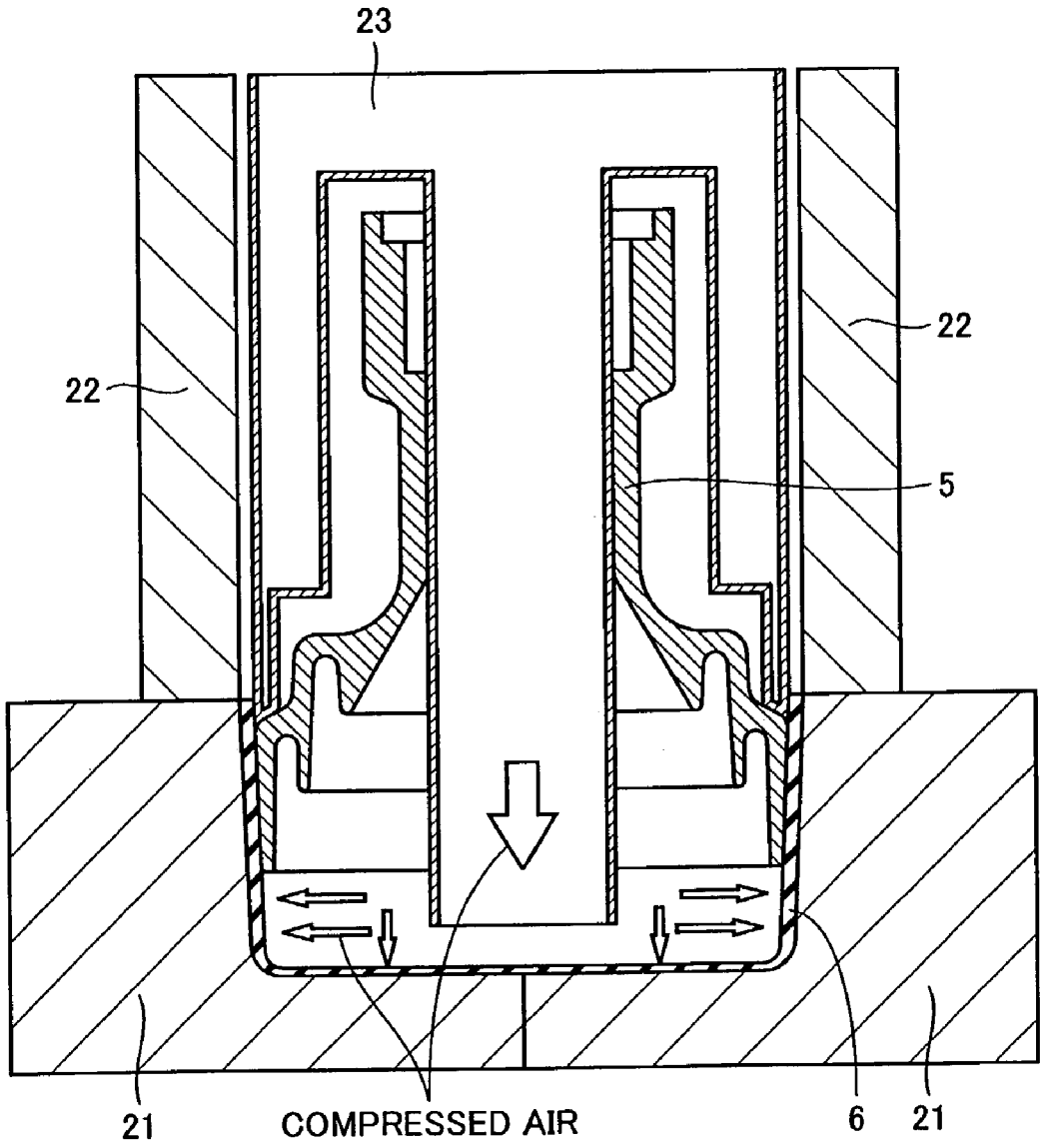
FIG. 3 is a cross sectional view showing the feed horn in a successive step to the step in FIG. 2, in which the parison is pressed with a blowing mold, and compressed air is blown in to finish a horn cap in a shape conforming to the inner surface of the blowing mold.

Next, a manufacturing method of the feed horn structure shown in FIG. 1 will be described. First, as shown in FIG. 2, feed horn 5 is mounted to blow molder 22 and 23. Then, a parison 26, which is a molded resin material, is mounted to one end of the feed horn and pressed with a blowing mold 21. Thereafter, as shown in FIG. 3, compressed air is blown in to finish horn cap 6 in a shape conforming to the inner surface of blowing mold 21. Through the manufacturing step above, feed horn 5 and horn cap 6 are effectively integrated without generating whitening, crack and the like.

(Second Embodiment)

Figure 4:
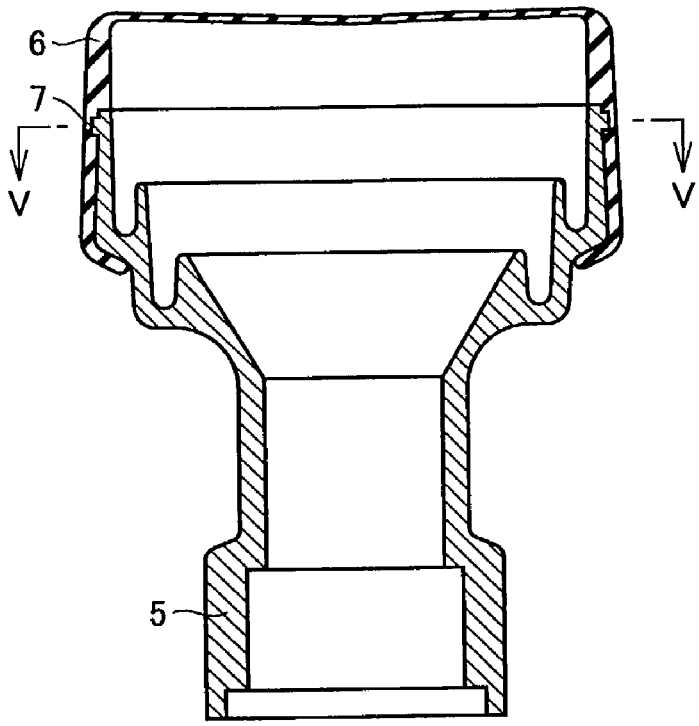
FIG. 4 is a front view showing vertical cross section of a feed horn structure according to a second embodiment of the present invention.
Figure 5:
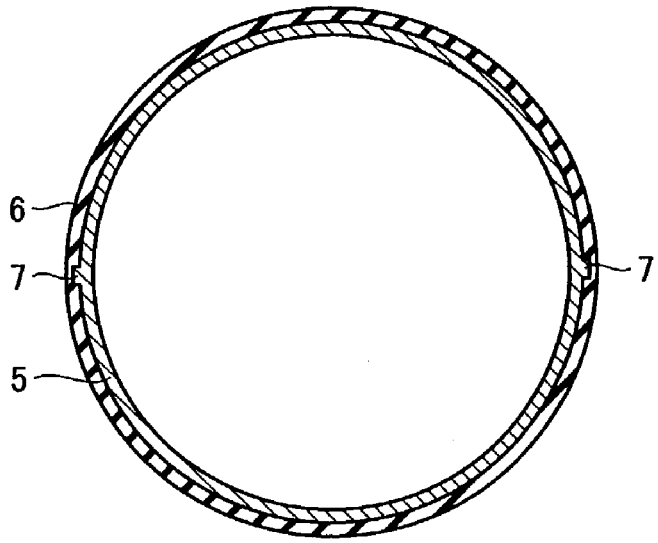
FIG. 5 is a horizontal cross sectional view along a line V—V in FIG. 4 of the feed horn structure according to the second embodiment of the present invention.

FIG. 4 is a front view showing vertical cross section of a feed horn structure according to a second embodiment. FIG. 5 is a horizontal cross sectional view along a line V—V in FIG. 4 of the feed horn structure according to the second embodiment. In the feed horn structure above, in order to prevent the rotational displacement of horn cap 6 relative to feed horn 5, a convex portion 7 is provided to feed horn 5 and a concave portion is provided to horn cap 6 to be mated with the convex portion.

Figure 6:
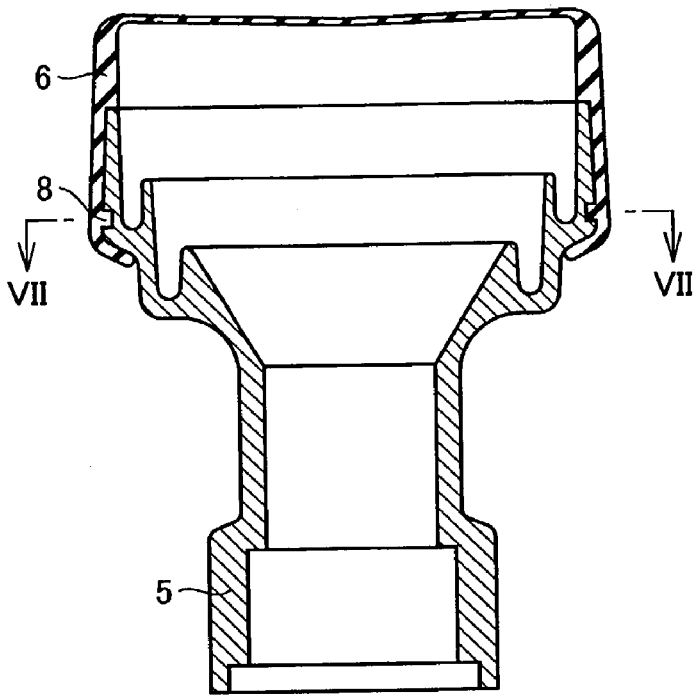
FIG. 6 is a front view showing vertical cross section of a feed horn structure according to a variation of the second embodiment of the present invention.
Figure 7:
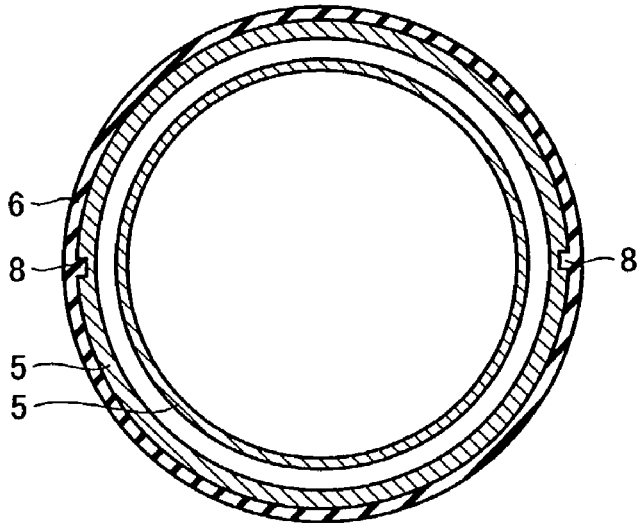
FIG. 7 is a horizontal cross sectional view along a line VII—VII in FIG. 6 of a feed horn structure according to a variation of the second embodiment of the present invention.

FIG. 6 is a front view showing vertical cross section of a feed horn structure according to a variation of the second embodiment. FIG. 7 is a horizontal cross sectional view along a line VII—VII in FIG. 6 of a feed horn structure according to a variation of the second embodiment. In this feed horn structure, in contrast to the feed horn structure in FIGS. 4 and 5, a concave portion 8 is provided to the feed horn and a convex portion is provided to the horn cap to be mated with the concave portion.

As above, by providing the convex portion and the concave portion mating with each other to the feed horn and the horn cap, the feed horn structure in which the rotational displacement of the horn cap is prevented and the airtightness is maintained can be obtained at low costs.

(Third Embodiment)

Figure 8:
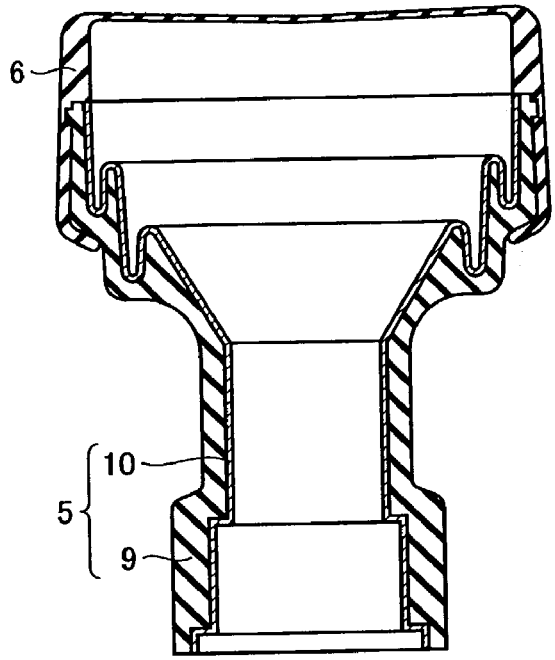
FIG. 8 is a front view showing vertical cross section of a feed horn structure according to a third embodiment of the present invention.

FIG. 8 is a front view showing vertical cross section of a feed horn structure according to a third embodiment. The feed horn structure of the third embodiment includes a feed horn 5 configured with a weather-resistant resin 9 molded into a feed horn shape and a plating layer 10 provided on the inner surface thereof. With the feed horn above, the feed horn structure can be integrated and yet its weight can be reduced.

Figure 9:
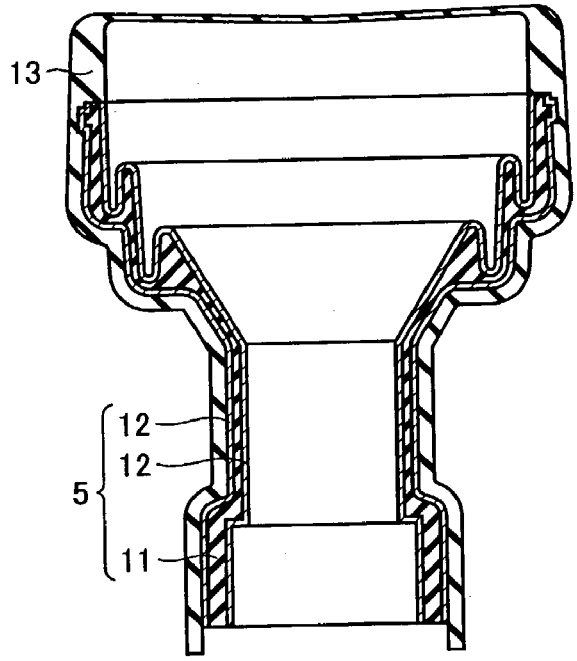
FIG. 9 is a front view showing vertical cross section of a feed horn structure according to a variation of the third embodiment of the present invention.

FIG. 9 a front view showing vertical cross section of a feed horn structure according to a variation of the third embodiment. In the variation of the third embodiment, feed horn 5 is configured with a feed horn shape 11 made with a general purpose resin entirely coated with a plating layer 12. A horn cap 13 is formed so as to cover the periphery of the feed horn. With the variation shown in FIG. 9, the feed horn structure, and therefore a converter, of lower costs compared to the feed horn structure in FIG. 8 can be provided.

(Fourth Embodiment)

Figure 10:
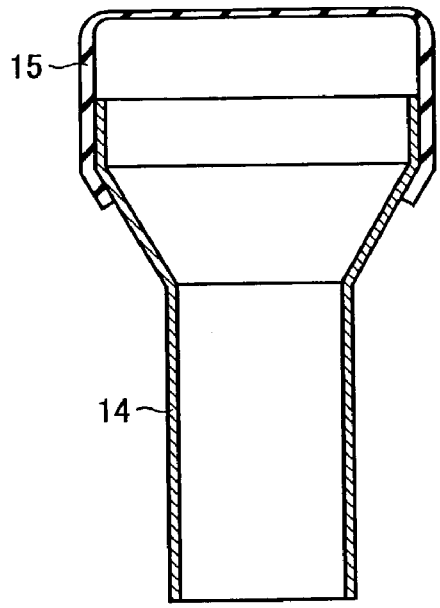
FIG. 10 is a front view showing vertical cross section of a feed horn structure according to a fourth embodiment of the present invention.
Figure 11:
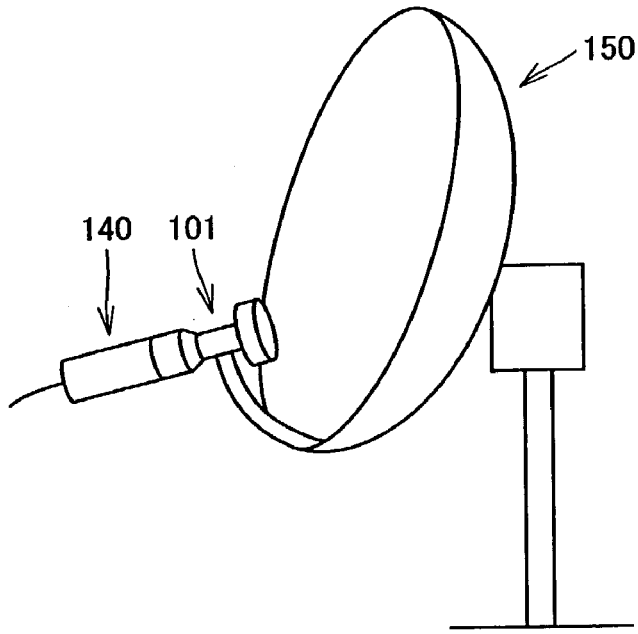
FIG.11 PRIOR ART
FIG. 11 is a perspective view of a configuration of a general satellite broadcasting receiving antenna.
Figure 12:
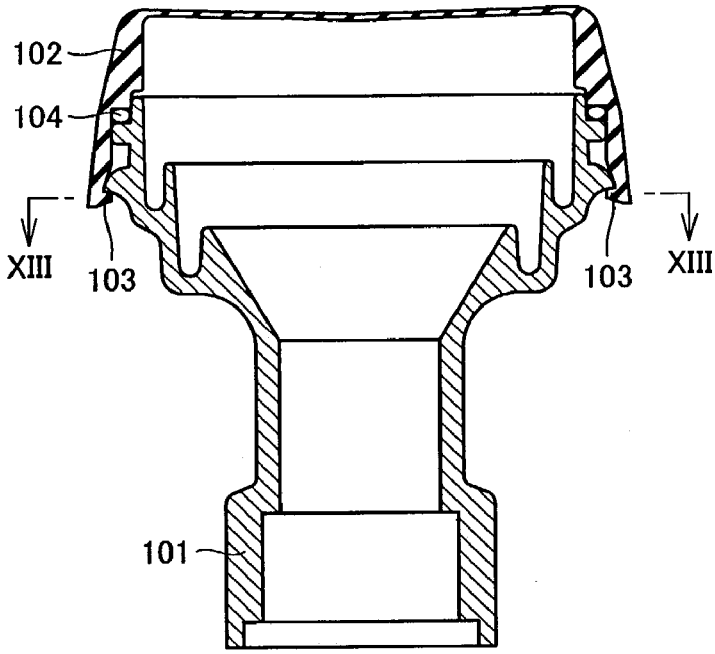
FIG.12 PRIOR ART
FIG. 12 is a front view showing vertical cross section of a conventional feed horn structure.
Figure 13:
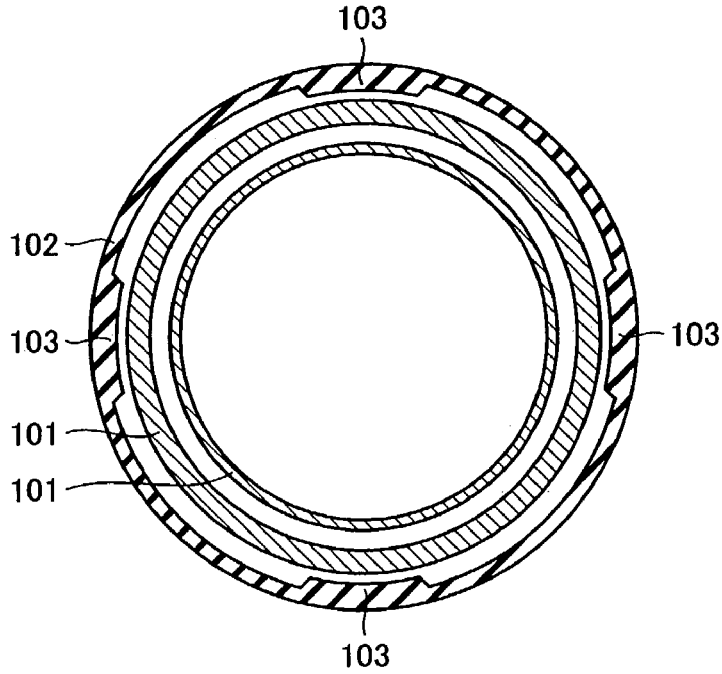
FIG.13 PRIOR ART
FIG. 13 is a horizontal cross sectional view along a line XIII—XIII in FIG. 12 of the conventional feed horn structure.

FIG. 10 is a front view showing vertical cross section of a feed horn structure according to a fourth embodiment of the present invention. The present embodiment includes a feed horn 14 to which a sheet metal working of an aluminum plate, a steel plate or the like is performed. By integrally molding this feed horn 14 and horn cap 15, feed horn structure can be formed easily, and LNB converter of low costs can be provided.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A feed horn structure of a satellite communication receiving converter, comprising:

a cylindrical feed horn having an opening for receiving a radio wave from an antenna portion and guiding the radio wave; and a horn cap that includes a wall portion extending from an opening of the feed horn and a connecting portion connecting the wall portion and covering the opening of the feed horn, and fixed to said feed horn so as to surround one end of said feed horn at an antenna side;

wherein, said feed horn and said horn cap are integrated, said horn cap is formed of a molded material, and said horn cap is a blow molded resin material, a space is located between the opening of the feed horn and the wall portion, and the space is defined between the wall portion and the connecting portion.

2. The feed horn structure according to claim 1, wherein said feed horn is a die-cast feed horn.

3. The feed horn structure according to claim 1, wherein said feed horn is configured with a weather-resistant resin provided with a metal plating on its inner surface.

4. The feed horn structure according to claim 1, wherein said feed horn is configured with a general purpose resin provided with a metal plating on its entire exterior surface.

5. The feed horn structure according to claim 1, wherein said feed horn is a feed horn formed by sheet metal working.

6. A satellite transmission receiving converter, comprising:

a cylindrical feed horn having an opening and receiving a radio wave from an antenna portion and guiding the radio wave; and a horn cap that includes a wall portion extending from an opening of the feed horn and a connecting portion connecting the wall portion and covering the opening of the feed horn, and fixed to said feed horn so as to surround one end of said feed horn at the antenna side, wherein, said feed horn and said horn cap are integrated, and said horn cap is a blow molded material, a space is located between the opening of the feed horn and the wall portion, and the space is defined between the wall portion and the connecting portion.

7. A satellite communication receiving antenna, comprising:

an antenna portion; and a converter; wherein said converter includes, a cylindrical feed horn having an opening receiving a radio wave from said antenna portion and guiding the radio wave, and a horn cap that includes a wall portion extending from an opening of the feed horn fixed to said feed horn so as to surround one end of said feed horn at antenna side; and wherein said feed horn and said horn cap are integrated, and said horn cap is a blow molded material, wherein a space is located between the opening of the feed horn and the wall portion; and the space is defined between the wall portion and a connecting portion.

* * * * *